US005382142A

United States Patent [19]

Spears

[11] Patent Number: 5,382,142

[45] Date of Patent: Jan. 17, 1995

[54] WALL PUMP HAVING BACKWASH VALVE ACTUATOR

[75] Inventor: Harry L. Spears, Tomball, Tex.

[73] Assignee: Spears Speciality Oil Tools, Inc., Tomball, Tex.

[21] Appl. No.: 43,187

[22] Filed: Apr. 6, 1993

[51] Int. Cl.[6] ..... F04B 7/00; F04B 21/02

[52] U.S. Cl. ..... 417/445; 417/554; 417/520; 417/555.2; 417/444; 137/515; 137/522

[58] Field of Search ..... 417/443, 444, 445, 446, 417/554, 510, 520, 555.2; 137/515, 515.3, 522

[56] References Cited

U.S. PATENT DOCUMENTS

| | | | |
|---|---|---|---|
| 880,019 | 2/1908 | Futhey | 417/554 |
| 984,084 | 2/1911 | Farrah | 417/443 |
| 1,771,690 | 7/1930 | Rankin | 417/445 |
| 2,690,134 | 9/1954 | Ritchey | 417/443 |
| 3,379,137 | 4/1968 | Harder | 417/445 |
| 4,599,054 | 7/1986 | Spears | 417/456 |

OTHER PUBLICATIONS

Corrosion Treating Tool—Moores—Undated—4 pages.

*Primary Examiner*—Richard A. Bertsch
*Assistant Examiner*—Roland G. McAndrews, Jr.
*Attorney, Agent, or Firm*—Ben D. Tobor

[57] ABSTRACT

A backwash valve for use in a sucker-rod actuated fluid pump, may be selectively actuated to permit both the standing and traveling ball valves to be unseated at the same time permit the pump to be backwashed and/or the production tubing string drained.

21 Claims, 3 Drawing Sheets

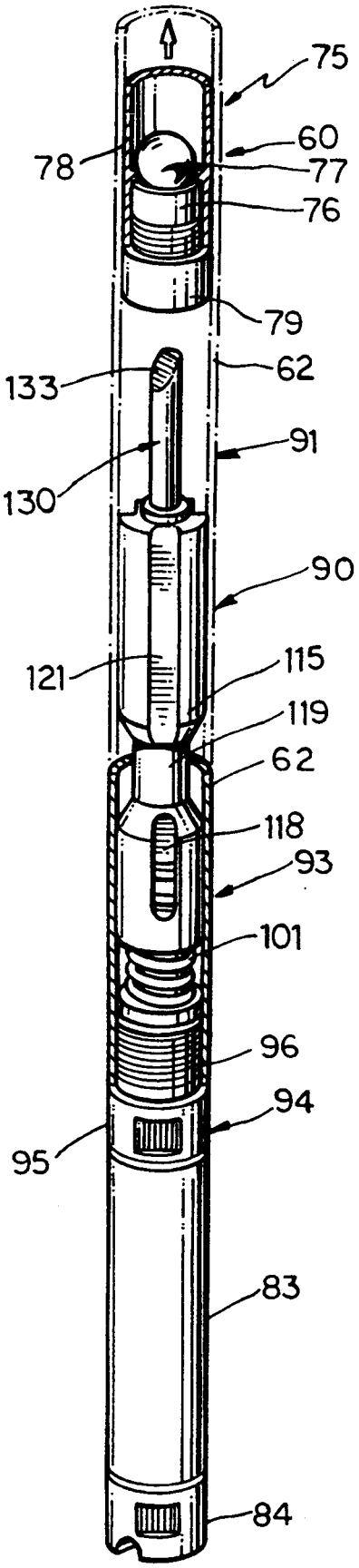
Fig. 2
Fig. 3
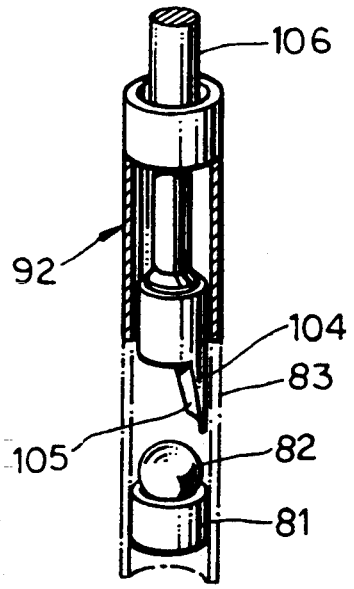

WALL PUMP HAVING BACKWASH VALVE ACTUATOR

BACKGROUND OF THE INVENTION

1. Field of the Invention

The invention relates to a backwash valve, for use in a sucker-rod actuated fluid pump disposed in a length of production tubing, which permits the pump and length of tubing to be drained.

2. Description of the Prior Art

A conventional oil well includes a cased well bore with one or more strings of tubing extending downwardly through casing into the oil or other petroleum fluid contained in the sub-surface mineral formation to be produced. The casing is perforated at the level of the production zone to permit fluid flow from the formation into the casing, and the lower end of the tubing string is generally open to provide entry for the fluid into the tubing.

One type of pump conventionally employed in structures of the type described is wedged into an internal constriction, or seating nipple, formed internally of the production tubing below the fluid level. A metallic enlargement on the external body of the pump prevents it from traveling below the seating nipple, and resilient seal rings on the body of the pump housing, or pump barrel, act to form a leak proof seal between the seating nipple and the pump housing, or barrel. Typically, beneath the seating nipple there are disposed a conventional gas anchor and mud anchor, the mud anchor having a perforated outer surface, through which the petroleum fluid may pass into the production tubing. The pump is generally driven by a mechanical linkage of metal rods, generally referred to as sucker-rods, or valve rods, which extend from the pump to the well surface. The valve rod, or sucker-rod, linkage is powered in a reciprocating motion by conventional mechanical apparatus, usually called a pumping unit, located at the well surface.

The conventional pump generally includes a housing through which a piston is reciprocated by the sucker-rod, or valve rod, linkage. In its simplest form, the conventional pump of the type described often includes a number of ball and seat valves with one such valve in the lower end of the moveable piston, and another at the inlet port of the housing or pump barrel. On the upstroke of the plunger, or moveable piston, the ball in the inlet port valve, or lower standing valve, is drawn away from its seat and the ball of the outlet port valve, or traveling valve, is forced over its seat to draw fluid from below the seating nipple and into the housing. On the piston's down stroke, the ball in the inlet valve, or standing valve, is forced onto its seat and the ball in the piston valve, or traveling valve, moves away from its seat to allow the piston, or plunger, to move downwardly through the fluid contained in the housing, or pump barrel. On the subsequent upstroke, the closing of the piston valve, or traveling valve, forces the fluid above the piston, or plunger out of the housing, or pump barrel, through its outlet ports and into the production tubing string above the pump and simultaneously fills the pump barrel below the piston with fluid. Repetition of this cycle eventually fills the production tubing, or tubing string, and causes the fluid to flow to the surface.

The previously described pump, or some variation thereof, is probably the most widely employed in applications where it is desired to drive a sub-surface pump by a surface powered, mechanical linkage. A significant problem in pumps of this type is that paraffin and other contaminants can adhere to the interior surface of the production tubing string, the paraffin and other contaminants being found in the petroleum fluid being pumped from the well. As the paraffin, and other materials, adhere to the interior surface of the production tubing, as well as the sucker-rod linkage, these materials can eventually decrease the amount of desired fluid which can be pumped through the tubing, because the paraffin coating can eventually, substantially block the passage of fluid upwardly through the production tubing string. In order to remove the undesired paraffin coating, it is then necessary to "hot oil" the well to remove the undesired paraffin coating. When a well is hot oiled, a quantity of oil, which has previously been produced from the well and is stored in a holding tank at the earth's surface, is heated and poured into the well through the annular space between the casing string and production tubing string. The quantity of heated oil, typically 60–70 barrels of heated oil, then passes down the annular space between the casing string and production tubing string, until it is in the well below the seating nipple in the production tubing string, at which time the heated oil is drawn upwardly into the production tubing string by the action of the pump. As the heated oil is pumped upwardly through the production tubing string, it melts the paraffin buildup within the production tubing string so that it will be pumped upwardly to the earth's surface and reenter the holding tank.

A major problem with this hot oiling technique is that much of the heat contained within the heated oil is dissipated as it passes down the well to a level below the seating nipple. The heated oil may lose much of its heat to the casing string and the exterior surface of the production tubing string, whereby the heated oil, upon entering the pump and production tubing string may not be as hot as necessary, or desired, to efficiently melt the paraffin coating on the interior surface of the production tubing string. Another problem associated with this hot oil process is that the heated oil may also dislodge other undesired materials, which are typically referred to as "gyp" or "scale", disposed upon the inner surface of the casing string, and this material is likewise pumped through the pump and into the production tubing string. Such other undesired contaminants, such as gyp and scale, as well as sand from the well, can cause sealing problems with the ball and seat valves contained in the pump, as well as can cause undesired corrosion of the other pump parts and the sucker-rod linkage which reciprocates the pump. Additionally, this undesired material and paraffin, is in turn pumped back into the holding tank where it collects, which is undesired, and may very likely be repumped back into the well when the well needs to be hot oiled again. It would be a definite advantage if the production tubing string could be drained through the pump and the heated oil poured directly into the interior of the production tubing string at the earth's surface.

In a similar fashion, many wells are chemically treated, wherein it is desired to apply corrosion inhibitors to the components of the pump and the sucker-rod linkage. The corrosion inhibitors, which can be quite expensive, are likewise passed into the annular cavity between the casing string and production tubing string until they pass to a location within the well adjacent the seating nipple. The corrosion inhibitor is then pumped upwardly by the pump and through the production tubing string, at which time the corrosion inhibitor coats the pump components and the sucker-rod linkage. Much of the expensive corrosion inhibitor can be lost as it passes down the annular cavity between the production tubing string and the casing string, in that the corrosion inhibitor will likewise coat the interior of the casing string and the exterior surface of the production tubing string, which do not need to be treated with the corrosion inhibitor. Again, it would be advantageous if the production tubing string could be chemically treated by pouring the chemicals directly into a drained production tubing string.

Another problem associated with such pumps is that if it becomes necessary to remove the production tubing string and pump from the well, it is not possible to open the traveling valve and standing valve of the pump to permit the fluid in the production tubing string to be drained downwardly through, and outwardly from, the pump. Thus, the fluid which has been previously pumped and is contained in the production tubing string above the pump must remain in the production tubing while the production tubing string is being raised to the earth's surface. This is typically referred to as "pulling a wet string". The removal and handling of the fluid contained in the production tubing string can present environmental problems if such fluid is not properly handled and stored as the wet string is being pulled out of the well.

Accordingly, prior to the development of the present invention, there has been no backwash valve, for use in a sucker-rod actuated fluid pump disposed in a length of production tubing, which: permits the production tubing string and sucker-rod linkage to be hot oiled by directly passing the heated oil into the production tubing string; permits the production tubing string and sucker-rod linkage to be chemically treated with corrosion inhibitors by directly injecting the corrosion inhibitors into the production tubing string; and permits the production tubing string to be drained prior to pulling the production tubing string to the earth's surface. Therefore, the art has sought a backwash valve, for use in a sucker-rod actuated fluid pump disposed in a length of production tubing which: permits the production tubing string and sucker-rod linkage to be hot oiled by directly injecting the heated oil into an empty production tubing string; permits corrosion inhibitors to be directly injected into the production tubing string to treat the interior of the production tubing string and the sucker-rod linkage disposed therein; and permits the production tubing string to be drained prior to pulling the production tubing string from the well.

SUMMARY OF THE INVENTION

In accordance with the present invention, the foregoing advantages have been achieved through the present backwash valve, for use in a sucker-rod actuated fluid pump disposed in a length of tubing, the pump having: a pump barrel with upper and lower ends; a moveable piston, with upper and lower ends, disposed within the pump barrel; a traveling valve assembly, including a first valve seat and a first ball valve, connected to the lower end of the moveable piston; and a standing valve assembly, including a second valve seat and a second ball valve disposed at the lower end of the pump barrel. The present invention includes: a traveling ball valve actuator for selective engagement with the ball valve of the traveling valve assembly to selective unseat the first ball valve from the seat; a standing ball valve actuator for selective engagement with the second ball valve of the standing ball valve assembly to selectively unseat the second ball valve from the second valve seat; control means for selectively actuating the standing ball valve actuator to engage the second ball valve when it is desired to unseat the second ball valve from the second valve seat; and means for connecting the standing ball valve actuator, traveling ball valve actuator, and control means to the lower end of the pump barrel, whereby upon selective, substantially simultaneous actuation of the standing ball and traveling ball actuators, any fluid contained in the pump and length of tubing may flow downwardly through, and outwardly from, the length of tubing and pump.

Another feature of the present invention is that the control means may include means for biasing the standing ball valve actuator away from the second ball valve during normal operation of the pump, and the biasing means may include a spring which exerts an upward force upon the standing ball valve actuator to urge the standing ball valve actuator away from the second ball valve. Another feature of the present invention is that the standing ball valve actuator may have an upper and a lower end, with at least one downwardly depending member at its lower end, the at least one downwardly depending member having an actuation surface thereon for selective engagement with the second ball valve. A further feature of the present invention is that the traveling ball valve actuator may be a stinger member having upper and lower ends, the upper end of the stinger member having an engagement surface for selective engagement with the first ball valve, and the stinger member may be a rod member and the engagement surface may be a beveled surface formed in the upper end of the rod member. An additional feature of the present invention is that the lower end of the stinger member may be operatively associated with the control means, and the stinger member is disposed above the control means, and the control means may be disposed above the standing ball valve actuator.

In accordance with another aspect of the present invention, the foregoing advantages have also been achieved through the present method for backwashing a sucker-rod actuated fluid pump disposed in a length of tubing, the pump having: a pump barrel with upper and lower ends; a moveable piston, with upper and lower ends, disposed within the pump barrel; a traveling valve assembly, including a first valve seat and a first ball valve, connected to the lower end of the moveable piston; a standing valve assembly, including a second valve seat and a second ball valve disposed in the lower end of the pump barrel; and a backwash valve disposed in the lower end of the pump barrel. The method of the present invention includes the steps of: lowering the piston within the pump barrel to a first position to cause the first ball valve of the traveling valve assembly to contact an engagement surface of a traveling ball valve actuator of the backwash valve to unseat the first ball valve from the first valve seat; continuing to lower the moveable piston within the pump barrel to a second position to cause the second ball valve of the standing valve assembly to contact an actuation surface of a standing ball valve actuator of the backwash valve, to unseat the second ball valve from the second valve seat; and maintaining the moveable piston in its second position within the pump barrel with the first and second ball valves unseated from the first and second valve seats, to permit a desired quantity of fluid in the pump and length of tubing to flow downwardly through, and outwardly from, the length of tubing and pump.

An additional feature of the method of the present invention may include the step of compressing a spring associated with the standing ball actuator, while the moveable piston is being lowered within the pump barrel to the second position, to overcome an upward biasing force exerted by the spring upon the standing ball valve actuator, whereby the actuation surface of the standing ball actuator may be moved into engagement with the second ball valve to unseat it from the second valve seat. A feature of the method of the present invention may include the step of raising the moveable piston to a third position within the pump barrel, until the moveable piston is in a spaced relationship from the backwash valve and the first and second ball valves are seated upon the first and second valve seats.

In accordance with another aspect of the present invention, the foregoing advantages have also been achieved through the present fluid pump adapted to be disposed in a length of tubing for pumping a fluid upwardly through the length of tubing. The fluid pump of the present invention includes: a pump barrel with upper and lower ends; a moveable piston, with upper and lower ends, disposed within the pump barrel; a traveling valve assembly, including a first valve seat and a first ball valve, connected to the lower end of the moveable piston; a standing valve assembly, including a second valve seat and a second ball valve disposed at the lower end of the pump barrel; and a backwash valve disposed in the lower end of the pump barrel and disposed between the standing valve assembly and the traveling valve assembly, the backwash valve including: a traveling ball valve actuator for selective engagement with the first ball valve of the traveling valve assembly to selectively unseat the first ball valve from the first valve seat; a standing ball valve actuator for selective engagement with the second ball valve of the standing ball valve assembly to selectively unseat the second ball valve from the second valve seat; control means for selectively actuating the standing ball valve actuator to engage the second ball valve when it is desired to unseat the second ball valve from the second valve seat; and means for connecting the standing ball valve actuator, traveling ball valve actuator, and control means to the lower end of the pump barrel, whereby upon selective, substantially simultaneous actuation of the standing ball and traveling ball valve actuators, any fluid contained in the pump and length of tubing may flow downwardly through, and outwardly from, the length of tubing and pump.

The backwash valve, method for backwashing a sucker-rod actuated fluid pump, and fluid pump of the present invention, when compared with previously proposed prior art backwash valves, methods for backwashing a sucker-rod actuated pump, and fluid pumps, have the advantages of permitting a well to be hot oiled by directly placing the heated oil into the production tubing string; permits the injection of corrosion inhibitors directly into the production tubing string; and permits the production tubing string and pump to be drained, so that when it is desired to pull the production string, it may be drained of any fluid contained within the production tubing string and pump, prior to it being pulled from the well.

BRIEF DESCRIPTION OF THE DRAWINGS

FIG. 2 is a partial cross-sectional view of a portion of the pump and backwash valve of FIGS. 1A and 1B during normal operation of the pump;

FIG. 3 is a partial cross-sectional view of the lower end of the backwash valve of FIGS. 1A and 1B during normal operation of the pump;

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1A:
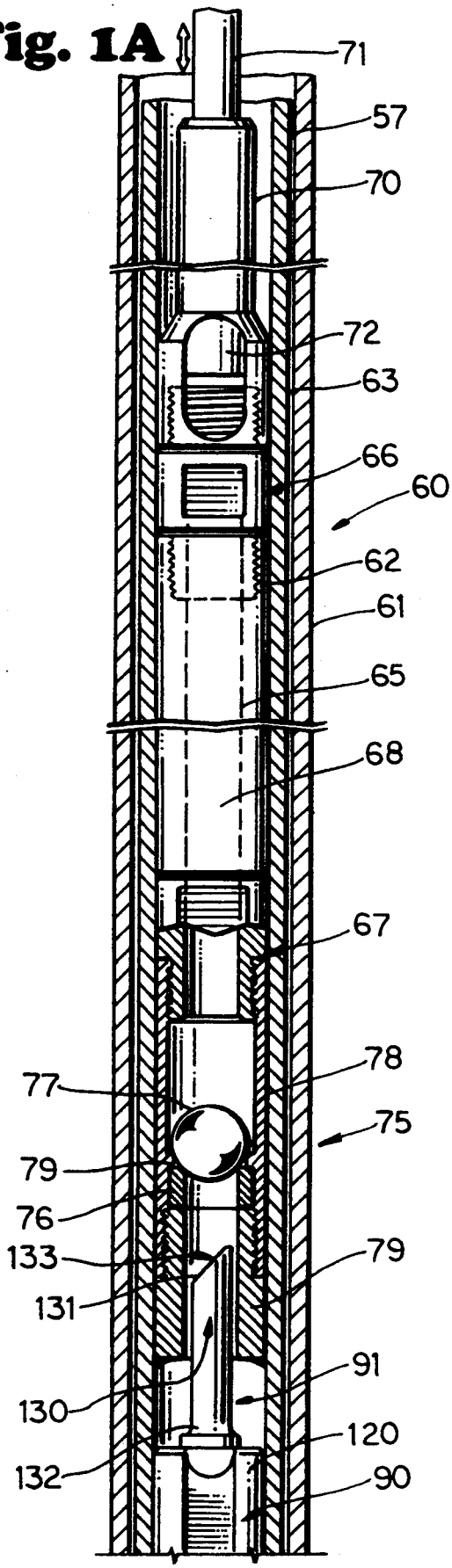
FIGS. 1A and 1B are partial cross-sectional views of a fluid pump having a backwash valve in accordance with the present invention.
Figure 1B:
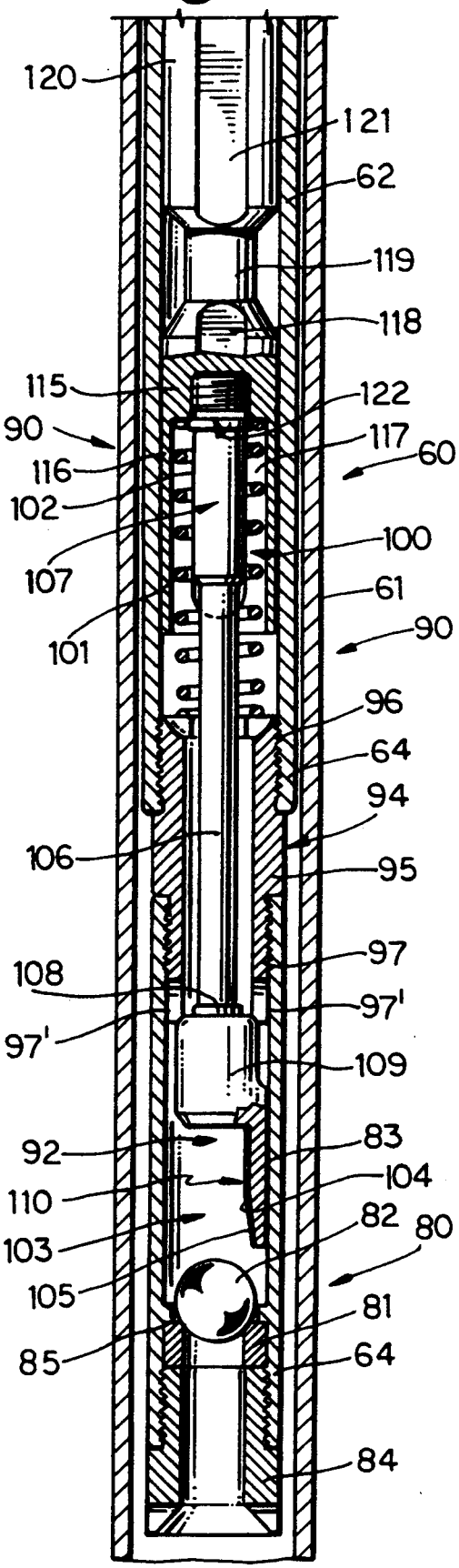

In FIGS. 1A and 1B a fluid pump 60 in accordance with the present invention, is shown disposed within a length of tubing, or production tubing string, 61, and pump 60 is utilized to pump petroleum fluids (not shown) upwardly through the length of production tubing 61. Pump 60 includes a pump barrel, or housing, 62 having upper and lower ends 63, 64, with a moveable piston, or plunger, 65, having upper and lower ends 66, 67 disposed within pump barrel 62. Moveable piston 65 is disposed in a sealing relationship with the interior surface of pump barrel 62, and typically includes a plurality of conventional o-ring seals (not shown) to maintain the desired sealing relationship. As is conventional in the art, moveable piston 65 includes at least one fluid passageway 68 disposed in the center of moveable piston 65. The upper end 66 of moveable piston 65 is threadedly received within a valve rod, or sucker-rod, connector member 70, which threadedly receives a sucker-rod, or valve rod, 71, as is conventional in the art. Sucker-rod connector member 70 preferably includes at least two fluid ports 72, whereby fluid passing through passageway 68 in moveable piston 65 may pass upwardly through fluid ports 72 and into the annular cavity 59 disposed between the sucker-rod connector member 70, sucker-rods 71, and the interior of pump barrel 62, and then pass into the annular cavity between the interior surface of production tubing string 61 and the sucker-rods 71.

Still with reference to FIGS. 1A and 1B, a traveling valve assembly 75, which includes a first valve seat 76 and a first ball valve 77 is connected to the lower end 67 of moveable piston 65. Traveling valve assembly 75 further includes a traveling valve cage 78 which is threaded upon the lower end 67 of moveable piston 65, and a seat plug 79, threadedly received in the lower end of the traveling valve cage 78, for securing the first valve seat 76 within traveling valve cage 78. The interior surface of traveling valve cage 78 may be provided with an internal flange 79 against which first valve seat 76 is disposed in an abutting relationship at its upper end, the lower end of first valve seat 76 being in an abutting relationship with the upper end of seat plug 79.

Still with reference to FIGS. 1A and 1B, the lower end 64 of pump barrel 62 is provided with a standing valve assembly 80 which preferably includes a second valve seat 81, a second ball valve 82, a standing valve cage 83 and a hold down assembly plug 84. Hold down assembly plug 84 is of conventional design and is adapted for mating with a conventional seating nipple (not shown) disposed beneath pump 60 within production tubing string 61. Second valve seat 81 is disposed within standing valve cage 83, its upper end abutting against an internal flange 85, and its lower end abutting against the upper end of hold down assembly plug 84.

As is conventional, and as previously described, on the upstroke of moveable piston 65 within pump barrel 62, the second ball valve 82 of standing valve assembly 80 is drawn away from its valve seat 81, and the fluid (not shown), disposed above first ball valve 77 of traveling valve assembly 75, forces first ball valve 77 upon its seat 76, whereby fluid from below pump 60, or below the seating nipple (not shown), is drawn into the pump barrel 62, in a conventional manner. On the down stroke of moveable piston 65, within pump barrel 62, as conventionally caused by the reciprocating motion of sucker-rods 71, the second ball valve 82 in standing valve assembly 80 is forced onto its valve seat 81, and the ball valve 77 of traveling valve assembly 75 moves upwardly away from valve seat 76 to allow the moveable piston 65 to move downwardly through the fluid disposed in the pump barrel 62 between the traveling valve assembly 75 and the standing valve assembly 80. On the subsequent upstroke of moveable piston 65, the seating of first ball valve 77 of traveling valve assembly 75 upon first valve seat 76, forces the fluid disposed above the traveling valve assembly upwardly through fluid passageway 68 of moveable piston 65, and through fluid ports 72 of sucker-rod connector member 70, and upwardly through the production tubing string 61. Simultaneously, during the upstroke of moveable piston 65, fluid is drawn into the pump barrel 62 through the opened ball valve 82 of standing valve assembly 80, as previously described. Repetition of this cycle eventually fills the tubing string 61 and causes the desired petroleum fluids to flow to the earth's surface (not shown).

Still with reference to FIGS. 1A and 1B, fluid pump 60 further includes a backwash valve 90 disposed in the lower end 64 of pump barrel 62, the backwash valve 90 being disposed between standing valve assembly 80 and the traveling valve assembly 75. Backwash valve 90 preferably includes a traveling ball valve actuator 91 for selective engagement with the first ball valve 77 of the traveling valve assembly 75 to selectively unseat the first ball valve 77 from the first valve seat 76; and a standing ball valve actuator 92 for selective engagement with the second ball valve 82 of the standing ball valve assembly 80 to selectively unseat the second ball valve 82 from the second valve seat 81. Backwash valve 90 preferably further includes a control means 93 for selectively actuating the standing ball valve actuator 92 to engage the second ball valve 82 when it is desired to unseat the second ball valve 82 from the second valve seat 81. A means for connecting 94 the standing ball valve actuator 92, traveling ball valve actuator 91, and control means 93 to the lower end 64 of the pump barrel 62 is provided. As will be hereinafter described in greater detail, upon selective, substantially simultaneous actuation of the standing ball and traveling ball valve actuators 92, 91, any fluid contained in the pump 60 and length of tubing, or production tubing string, 61 may flow downwardly through, and outwardly from, the length of tubing 61 and pump 60.

Still with reference to FIGS. 1A and 1B, connecting means 94 includes a tubular shaped member 95 having a first threaded surface 96 which threadedly mates with the lower end 64 of pump barrel 62 and a second threaded surface 97 which threadedly mates with standing ball valve cage 83 which receives the second ball valve 82 and second valve seat 81 as previously described. The lower end of the tubular shaped member 95 is preferably provided with fluid ports 97' to permit fluid to pass when the upper end of plug member 109, to be hereinafter described, is in an abutting relationship with the lower end of tubular shaped member 95, as shown in FIG. 1B.

Figure 5:
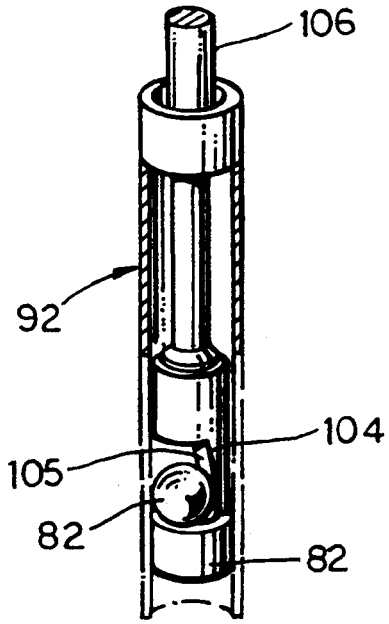
FIG. 5 is a partial cross-sectional view of the lower end of the backwash valve of FIGS. 1A and 1B, during backwashing of the pump.

Control means 93 includes a means for biasing 100 the standing ball valve actuator 92 away from the second ball valve 82 during normal operation of the pump 60 as will be hereinafter described in greater detail. Biasing means 100 is preferably a spring 101 which exerts an upward force upon the standing ball valve actuator 92 to urge the standing ball valve actuator 92 away from the second ball valve 82. Standing ball valve actuator 92 has an upper and lower end 102, 103, with at least one downwardly depending member 104 at its lower end 103. The at least one downwardly depending member 104 has an actuation surface 105 thereon for selective engagement with the second ball valve 82. Standing ball valve actuator 92 preferably includes a rod member 106 having upper and lower ends 107, 108, the lower end 108 of the rod member 106 having the at least one downwardly depending member 104 threadedly secured to the lower end 108 of rod member 106. The at least one downwardly depending member 104 is preferably disposed in a sliding relationship against the inner surface of standing ball valve cage 83, and is secured to the lower end 108 of rod member 106 as by an enlarged, rod-shaped plug member 109 which threadedly mates with the lower end 108 of rod member 106. The at least one downwardly depending member 104 is preferably formed integral with the rod-shaped plug member 109. Actuation surface 105 is preferably formed upon the inwardly facing, inner surface 110 of the at least one downwardly depending member 104, and actuation surface 105 is preferably a downwardly tapered surface having an arcuate configuration, as seen in FIGS. 3 and 5, for engagement with first ball valve 82. Surface 110 of actuation surface 105 thus has a generally rounded, smooth configuration, so that upon selective engagement of actuation surface 105 with second ball valve 82, downwardly depending member 104 will not damage, or nick, the outer surface of the second ball valve 82.

Still with reference to FIGS. 1A and 1B, the upper end 107 of rod member 106 is threadedly received within an intermediate connector member, or mini-plunger, 115 which is disposed in the sliding relationship with the interior surface of pump barrel 62. Intermediate connector member 115, has a lower end 116 with a generally tubular shaped configuration with an annular space 117 formed therein, in which the upper end of rod member 106 passes through, with spring 101 of biasing means 100 surrounding the upper end 107 of rod member 106. The lower end 116 of intermediate connector member, or mini-plunger, 115 is provided with a number of fluid passageways, or openings, 118

(FIGS. 2 and 4) through which fluid may pass upwardly or downwardly past intermediate connector member 115. Intermediate connector member 115 may have a reduced neck portion 119 disposed between the upper and lower ends 120, 116 of intermediate connector member 115. The upper end 120 of intermediate connector member 15 may have a generally cylindrical cross-sectional configuration, with a plurality of fluid passageways, or keyways, 121 which likewise permit fluid to pass upwardly or downwardly past the upper end 120 of intermediate connector member 115. Intermediate connector member 115 serves to centralize backwash valve 90 within pump barrel 62, as well as permits biasing means 100 of control means 93 to exert the desired upward biasing force upon rod member 106 of standing ball valve actuator 92. The connecting means 94, or tubular shaped member 95 is fixedly secured within the lower end 64 of pump barrel 62, and spring 101 of biasing means 100 is disposed in an abutting relationship with the upper end of tubular shaped member 95 and the upper surface 122 of the lower end 116 of intermediate connector member 115 above annular space 117, spring 101 thus exerts an upward force, upon standing ball valve actuator 92 by pushing intermediate connector member 115, with rod member 106 secured thereto, upwardly within pump barrel 62.

As shown in FIGS. 1A and 1B, traveling ball valve actuator 91 is a stinger member 130 having upper and lower ends 131, 132, the upper end of 131 of stinger member 130 having an engagement surface 133 for selective engagement with the first ball valve 77. Stinger member 130 is preferably a rod shaped member 134 and the engagement surface 133 is preferably a beveled surface formed on the upper end 131 of rod member 134. The lower end 132 of the stinger member 130 is preferably, operatively associated with control means 93, as by being threadedly received within the upper end 120 of intermediate connector member 115, whereby the stinger member 130 is disposed above the control means 93, and the control means 93 is disposed above the standing ball valve actuator 92.

With reference now to FIGS. 2–5, the method of the present invention for backwashing a sucker-rod actuated fluid pump 60, and the operation of pump 60 and backwash valve 90 will be described. In FIGS. 2 and 3, backwash valve 90 is shown disposed within fluid pump 60 in the position it would have during normal pumping operations of pump 60 within production tubing string 61 (FIGS. 1A and 1B). During normal pumping operations with pump 60, moveable piston 65, with traveling valve assembly 75 secured to the lower end of moveable piston 65, will always be disposed in a spaced relationship from backwash valve 90, whereby the stinger member 130 of traveling ball valve actuator 91 will not pass through seat plug 79 of traveling valve assembly 75 to engage first ball valve 77 to unseat first ball valve 77 from first valve seat 76. This is accomplished by disposing pump 60 within production tubing string 61 with the hold down assembly plug 84 disposed within a conventional seating nipple (not shown), with moveable piston 65 disposed within pump barrel 62 in a spaced out relationship, whereby upon upward and downward reciprocation of sucker-rods 71, moveable piston 65 will not contact any part of backwash valve 90. While backwash valve 90 is in the configuration illustrated in FIGS. 2 and 3, control means 93, by operation of spring 101 of biasing means 100 exerting an upward biasing force upon standing ball valve actuator 92 as previously described, keeps rod member 106 urged upwardly, whereby the at least one downwardly depending member 104 of standing ball valve actuator 92 will be spaced from, and not in engagement with, the second ball valve 82 of standing valve assembly 80, as shown in FIG. 3.

When backwash valve 90 and pump 60 are in the configuration illustrated in FIGS. 2 and 3, normal pumping operations may be conducted as previously described. Upon the upstroke of moveable piston 65, traveling ball valve 77 remains seated against first valve seat 76, and the upward suction force exerted by moveable piston 65 draws fluid into pump 60 through second valve seat 81, while second ball valve 82 is drawn upwardly away from second valve seat 81. The desired petroleum fluids are thus drawn upwardly through standing valve assembly 80 and into the lower end 64 of pump barrel 62. Upon the down stroke of moveable piston 65, second ball valve 82 assumes its seated relationship with second valve seat 81, as shown in FIG. 3, and as moveable piston 65 moves downwardly in the fluid disposed beneath first valve seat 76, such fluid moves upwardly through first valve seat 76 and unseats first ball valve 77. The fluid thus moves upwardly through passageway 68 (FIG. 1A) of moveable piston 65, through fluid ports 72 of sucker-rod connector member 70, and into production tubing string 61. Thus, it is seen that fluid pump 60, when in the configuration illustrated in FIGS. 2 and 3 operates in a conventional manner to pump fluid upwardly through production tubing string 61 toward the earth's surface.

When it is desired to: backwash the sucker-rod actuated fluid pump 60; hot oil the interior of the production tubing string 61, or chemically treat pump 60 and the sucker-rod linkage 71 and interior of production tubing string 61 with chemicals, such as corrosion inhibitors, the backwash valve is operated as hereinafter described. It should be noted that the use of the term "backwashing" in the present specification and claims includes any process wherein fluid contained within production tubing string 61 flows downwardly through, and outwardly from, the production tubing string 61 and pump 60, into the well. Thus, the use of the term "backwashing" encompasses: draining the production tubing string through pump 60, to permit a dry production tubing string 61 to be pulled from the well; hot oiling the interior of the production tubing string 61 by flowing heated oil directly into the interior of the production tubing string from the earth's surface; and chemically treating the interior of the production tubing string and sucker-rod linkage 71, by directly passing the desired chemicals, such as corrosion inhibitors, into the interior of the production tubing string from the earth's surface.

Figure 4:
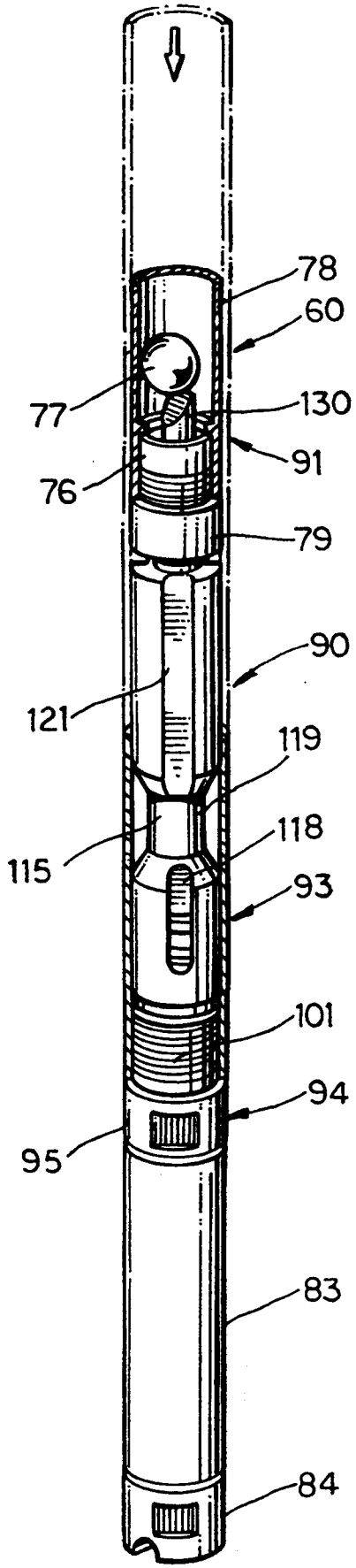
FIG. 4 is a partial cross-sectional view of a portion of the pump and backwash valve of FIGS. 1A and 1B, during backwashing of the pump.

To accomplish the desired backwashing of pump 60, the moveable piston, or plunger 65, is lowered within the pump barrel 62 to a first position within pump barrel 62 to cause the first ball valve 77 of the traveling valve assembly 75 to contact the engagement surface 133 of the traveling ball valve actuator 91 to unseat the first ball valve 77 from the first valve seat 76, as illustrated in FIG. 4. This first position is accomplished when moveable piston 65 is lowered within pump well 62, until stinger member 130 of traveling ball valve actuator 91 contacts first ball valve 77 and unseats it from first ball valve seat 76 as shown in FIG. 4.

The lowering of moveable piston, or plunger, 65 is continued within pump 62 to a second position to cause the second ball valve 82 of standing valve assembly 80 to contact an actuation surface 105 of the standing ball valve actuator 92 of backwash valve 90, to unseat the second ball valve 82 from the second valve seat 81 as shown in FIG. 5. This second position is accomplished by continuing to lower moveable piston 65 until seat plug 79 abuts against the upper end 120 of intermediate connector member 115, which compresses spring 101 of biasing means 100 and overcomes the upward biasing force of spring 101 until standing ball valve actuator 92 moves downwardly to unseat second ball valve 82, as shown in FIG. 5. By maintaining the moveable piston 65 in its second position within pump barrel 62, and compressing spring 101 within the annular space 117 of intermediate connector member 115, the first and second ball valves 77 are both disposed in an unseated relationship with their respective valve seats 76, 81. A desired quantity of fluid in the pump 60 and length of production tubing 61 may then flow downwardly through, and outwardly from, the production tubing string 61 and pump 60 into the well. The desired quantity of fluid may be: substantially all of the petroleum fluid contained within production tubing string 61 disposed above pump 60, whereby a dry production tubing string 61 may be raised from-the well; a quantity of heated oil which has been directly placed within the interior of the production tubing string 61 at the earth's surface for hot-oiling the production tubing string 61 after the production tubing string has been drained; or a quantity of chemicals, such as corrosion inhibitors, which are directly disposed within the interior of production tubing string 61 at the earth's surface after the production tubing string has been drained. All of the foregoing fluids may thus flow downwardly through, and outwardly from, the production tubing string 61 and pump 60 into the well below the seating nipple. Backwash valve 90 may be operated in the manner previously described when it is only desired to backwash pump 60 in order to cause any sand, or other undesired material, from pump 60 to flow into the well below the seating nipple. Additionally, such backwashing could be carried when it is desired to cause fluid to drain from pump 60 to backwash a conventional mud anchor which may be disposed below the seating nipple.

Upon raising the movable piston 65 to a third position within the pump barrel 62, until the moveable piston 65 is in a spaced relationship from backwash valve 90, as shown in FIG. 2, the first and second ball valves 77, 82 are again seated upon the first and second valve seats 76, 81. While the moveable piston is in this third position, in a spaced relationship from backwash valve 90, normal pumping operations may be conducted as previously described, until it is then again desired to backwash pump 60, as previously described.

It is to be understood that the invention is not limited to the exact details of construction, operation, exact materials, or embodiment shown and described, as obvious modifications and equivalents will be apparent to one skilled in the art. For example, if it is only desired to activate the backwash valve a single time, at least one shear pin could be substituted for the spring of the control means, the shear pin releasably securing the standing ball valve actuator in its spaced, non-engaging relationship with the second ball valve. Upon applying a downward force upon the backwash valve, the shear pin would be sheared and the standing ball valve actuator may engage the second ball valve to unseat it. According, the invention is therefore to be limited only by the scope of the appended claims.

I claim:

1. A backwash valve actuator, for use in a sucker-rod actuated fluid pump disposed in a length of tubing, the pump having: a pump barrel with upper and lower ends, a moveable piston, with upper and lower ends, disposed within the pump barrel; a traveling valve assembly, including a first valve seat and a first ball valve, connected to the lower end of the moveable piston; and a standing valve assembly, including a second valve seat and a second ball valve disposed at the lower end of the pump barrel, comprising:

a traveling ball valve actuator for selective engagement with the first ball valve of the traveling valve assembly to selectively unseat the first ball valve from the first valve seat;

a standing ball valve actuator for selective engagement with the second ball valve of the standing ball valve assembly to selectively unseat the second ball valve from the second valve seat;

control means for selectively actuating the standing ball valve actuator to engage the second ball valve when it is desired to unseat the second ball valve from the second valve seat; and means for connecting the standing ball valve actuator, traveling ball valve actuator, and control means to the lower end of the pump barrel, including a tubular shaped member having a first threaded surface upon selective, substantially simultaneous actuation of the standing ball and traveling ball valve actuators, any fluid contained in the pump and length of tubing may flow downwardly through, and outwardly from, the length of tubing and pump.

2. The backwash valve actuator of claim 1, wherein the tubular shaped member has a second threaded surface which threadedly mates with a standing ball valve cage adapted to receive the second ball valve and second valve seat.

3. The backwash valve actuator of claim 1, wherein the standing ball valve actuator includes a rod member having upper and lower ends, the lower end of the rod member having at least one downwardly depending member having an actuation surface thereon for selective engagement with the second ball valve; the upper end of the rod member being upwardly biased away from the second ball valve by a spring.

4. The backwash valve actuator of claim 1, wherein the control means includes means for biasing the standing ball valve actuator away from the second ball valve during normal operation of the pump.

5. The backwash valve actuator of claim 4, wherein the biasing means includes a spring which exerts an upward force upon the standing ball valve actuator to urge the standing ball valve actuator away from the second ball valve.

6. The backwash valve actuator of claim 1, wherein the standing ball valve actuator has an upper and a lower end, with at least one downwardly depending member at its lower end, the at least one downwardly depending member having an actuation surface thereon for selective engagement with the second ball valve.

7. The backwash valve actuator of claim 6, wherein the upper end of the standing ball valve actuator is disposed within a spring which exerts an upward force upon the standing ball valve actuator to bias the actuation surface of the standing ball valve actuator upward and away from the second ball valve during normal operation the pump.

8. The backwash valve actuator of claim 1, wherein the traveling ball valve actuator is a stinger member having upper and lower ends, the upper end of the stinger member having an engagement surface for selective engagement with the first ball valve.

9. The backwash valve actuator of claim 8, wherein the stinger member is a rod member and the engagement surface is a beveled surface formed on the upper end of the rod member.

10. The backwash valve actuator of claim 8, wherein the lower end of the stinger member is operatively associated with the control means, and the stinger member is disposed above the control means, and the control means is disposed above the standing ball valve actuator.

11. A fluid pump adapted to be disposed in a length of tubing for pumping a fluid upwardly through the length of tubing, comprising:

a pump barrel with upper and lower ends;

a moveable piston, with upper and lower ends, disposed within the pump barrel;

a traveling valve assembly, including a first valve seat and a first ball valve, connected to the lower end of the moveable piston;

a standing valve assembly, including a second valve seat and a second ball valve disposed at the lower end of the pump barrel; and a backwash valve actuator disposed in the lower end of the pump barrel and assembly, the backwash valve including: a traveling ball valve actuator for selective engagement with the first ball valve of the traveling valve assembly to selectively unseat the first ball valve from the first valve seat; a standing ball valve actuator for selective engagement with the second ball valve of the standing ball valve assembly to selectively unseat the second ball valve from the second valve seat; control means for selectively actuating the standing ball valve actuator to engage the second ball valve when it is desired to unseat the second ball valve from the second valve seat; and means for connecting the standing ball valve actuator, traveling ball valve actuator, and control means to the lower end of the pump barrel, including a tubular shaped member having a first threaded surface which threadedly mates with the lower end of the pump barrel, whereby upon selective, substantially simultaneous actuation of the standing ball and traveling ball valve actuators, any fluid contained in the pump and length of tubing may flow downwardly through, and outwardly from, the length of tubing and pump.

12. The pump of claim 11, wherein the tubular shaped member has a second threaded surface which threadedly mates with a standing ball valve cage which receives the second ball valve and second valve seat.

13. The pump of claim 11, wherein the standing ball valve actuator includes a rod member having upper and lower ends, the lower end of the rod member having at least one downwardly depending member having an actuation surface thereon for selective engagement with the second ball valve; the upper end of the rod member being upwardly biased away from the second ball valve by a spring.

14. The pump of claim 11, wherein the backwash valve actuator is disposed in the pump barrel in a spaced relationship from the lower end of the moveable piston during normal operation of the pump.

15. The pump of claim 11, wherein the control means includes means for biasing the standing ball valve actuator away from the second ball valve during normal operation of the pump.

16. The pump of claim 15, wherein the biasing means includes a spring which exerts an upward force upon the standing ball valve actuator to urge the standing ball valve actuator away from the second ball valve.

17. The pump of claim 11, wherein the standing ball valve actuator has an upper and a lower end, with at least one downwardly depending member at its lower end, the at least one downwardly depending member having an actuation surface thereon for selective engagement with the second ball valve.

18. The pump of claim 17, wherein the upper end of the standing ball valve actuator is disposed within a spring which exerts an upward force upon the standing ball valve actuator to bias the actuation surface of the standing ball valve actuator upward and away from the second ball valve during normal operation the pump.

19. The pump of claim 11, wherein the traveling ball valve actuator is a stinger member having upper and lower ends, the upper end of the stinger member having an engagement surface for selective engagement with the first ball valve.

20. The pump of claim 19, wherein the stinger member is a rod member and the engagement surface is a beveled surface formed on the upper end of the rod member.

21. The pump of claim 19, wherein the lower end of the stinger member is operatively associated with the control means, and the stinger member is disposed above the control means, and the control means is disposed above the standing ball valve actuator.

* * * * *

UNITED STATES PATENT AND TRADEMARK OFFICE

CERTIFICATE OF CORRECTION

PATENT NO. : 5,382,142

DATED : January 17, 1995

INVENTOR(S) : Harry L. Spears

It is certified that error appears in the above-identified patent and that said Letters Patent is hereby corrected as shown below:

In Column 12, Line 28, after "surface" insert -- adapted to threadedly mate with the lower end of the pump barrel, whereby --.

In the cover page of the patent, Line 54, delete "WALL", and insert -- WELL --.

In Column 1, Line 2, delete "WALL", and insert --WELL --。

Signed and Sealed this

Eighteenth Day of April, 1995

Bruce Lehman

*Attest:*

BRUCE LEHMAN

*Commissioner of Patents and Trademarks*

*Attesting Officer*